US010421651B1

(12) United States Patent
Coleman et al.

(10) Patent No.: US 10,421,651 B1
(45) Date of Patent: Sep. 24, 2019

(54) LIFTING DEVICE

(71) Applicant: ESK, LLC, Plant City, FL (US)

(72) Inventors: Earl W. Coleman, Plant City, FL (US); Steven R. Haigler, Plant City, FL (US); Kenton V. Pickens, Wesley Chapel, FL (US)

(73) Assignee: ESK, LLC, Plant City, FL (US)

( * ) Notice: Subject to any disclaimer, the term of this patent is extended or adjusted under 35 U.S.C. 154(b) by 242 days.

(21) Appl. No.: 15/429,281

(22) Filed: Feb. 10, 2017

Related U.S. Application Data

(60) Provisional application No. 62/295,232, filed on Feb. 15, 2016.

(51) Int. Cl.

| | |
|---|---|
| ***B66D 3/00*** | (2006.01) |
| ***E06C 7/12*** | (2006.01) |
| ***B66D 3/26*** | (2006.01) |
| *B66D 3/02* | (2006.01) |

(52) U.S. Cl.
CPC ..... *B66D 3/00* (2013.01); *B66D 3/26* (2013.01); *E06C 7/12* (2013.01); *B66D 3/02* (2013.01); *B66D 2700/0116* (2013.01); *B66D 2700/0141* (2013.01); *B66D 2700/0183* (2013.01)

(58) Field of Classification Search
CPC ... B66D 3/00; B66D 3/02; B66D 3/20; B66D 3/26; B66D 2700/0116; B66D 2700/0183; B66D 2700/0141; E06C 7/12
See application file for complete search history.

(56) References Cited

U.S. PATENT DOCUMENTS

| | | | | |
|---|---|---|---|---|
| 283,530 | A * | 8/1883 | Swartz | E06C 7/12 182/102 |
| 3,902,700 | A | 9/1975 | Cox | |
| 4,128,228 | A | 12/1978 | Ziegelmann | |
| 4,598,795 | A | 7/1986 | Larson | |
| 4,690,248 | A * | 9/1987 | Killeen | E06C 1/39 182/118 |
| 4,770,273 | A | 9/1988 | McMakin et al. | |
| 5,139,108 | A | 8/1992 | Pate | |
| 5,427,356 | A | 6/1995 | Krotov et al. | |
| 5,738,185 | A * | 4/1998 | Sears | E06C 7/12 182/102 |
| 6,454,049 | B1 | 9/2002 | Dorsett | |
| 6,830,130 | B2 | 12/2004 | Webb et al. | |

* cited by examiner

*Primary Examiner* — Sang K Kim
*Assistant Examiner* — Nathaniel L Adams
(74) *Attorney, Agent, or Firm* — Frijouf, Rust & Pyle, P.A.

(57) ABSTRACT

A lifting device is disclosed for elevating an object between a first elevation and a second elevation. The lifting device comprises a base frame, a load bearing frame coupled to the base frame, an elevation reducing frame coupled to the load bearing frame and an extension frame coupled to the elevation reducing frame. A mounting bracket is coupled to the base frame. The mounting bracket engages a rung of a ladder. A load winch is coupled to the load bearing frame and lifts the object and transferring the weight of the object to the ladder. The base frame, the load bearing frame and the elevation reducing frame define an object chamber for receiving the object in the object chamber and increasing the elevation of the object relative to the extension frame.

9 Claims, 13 Drawing Sheets

LIFTING DEVICE

CROSS-REFERENCE TO RELATED APPLICATIONS

This application claims benefit of U.S. Patent Provisional Application No. 62/295,232 filed Feb. 15, 2016. All subject matter set forth in U.S. Patent Provisional Application No. 62/295,232 is hereby incorporated by reference into the present application as if fully set forth herein.

BACKGROUND OF THE INVENTION

Field of the Invention

This invention relates to lifting devices and more particularly to a lifting device utilizing a ladder.

Background of the Invention

Raising heavy loads such as HVAC equipment and the like to structure roof tops presents substantial problems to those persons involved in these tasks. When addressing tall structures, cranes are generally utilized and in some cases, heavy lift helicopters place the loads in their desired location. When addressing single story structures involving lighter loads, cranes and the like are precluded from use, since the price to raise comparatively light loads a relatively short height is not cost affective. Safely raising small to moderate HVAC equipment and the like to roof tops of single story structures required a simple solution to this lifting problem.

There have been many in the prior art who have attempted to solve these problems with varying degrees of success. None, however completely satisfies the requirements for a complete solution to the aforestated problem. The following U. S. Patents are attempts of the prior art to solve this problem.

U.S. Pat. No. 3,902,700 to Cox discloses a portable bridge-crane structure designed to provide means of lifting construction materials and equipment such as compressors for air conditioners to the roof of a building where construction or installation is to be performed. The portable bridge-crane structure being supported at a distance above ground between a step ladder and the wall and the roof of a building where construction or installation is to be done.

U.S. Pat. No. 4,128,228 to Ziegelmann discloses a support having a hoist for raising and lowering articles from one elevation to another in which one portion of the support is a ladder.

U.S. Pat. No. 4,598,795 to Larson discloses a ladder hoist attachment consisting of a boom and prop combination that allows a conventional ladder to be used to hoist heavy loads. The boom assembly consists of a number of feet that removably attach to a rung of the ladder, a boom that extends horizontally over the top rung of the ladder; and braces connecting the feet and boom that also rest against the top rung of the ladder. One end of the prop removably attaches to a lower rung of the ladder. The other end of the prop has a vertical step to hold the ladder at a predetermined distance away from the edge of the roof. A winch or pulley is suspended from the end of the boom extending over the top rung of the ladder to allow loads to be lifted through the prop and between the ladder and the building. After the load has been lifted above the height of the roof, the end of the prop against the building is lifted by the user to allow the ladder to be moved to rest against the edge of the roof thus allowing the load to be lowered on to the roof.

U.S. Pat. No. 4,770,273 to McMakin discloses a lifting apparatus usable to lift heavy loads from the ground to a roof surface including a horizontally positioned, shoulder mounted lifting bar or beam with a winch means, fastened to the bar or beam where one end of the lifting bar or beam is pivotally connected to a vertically positioned ladder or extension ladder, with means to allow pivotal rotation of the upper end of the ladder toward the roof to deposit the load on the roof or into a window of a multi-story building.

U.S. Pat. No. 5,139,108 to Pate discloses a stabilized ladder power winch assembly including a winch mounting subassembly with two channeled portions, a reversible mount bracket subassembly with a cantilevered portion, a tiltable prop subassembly having a safety rung support extension, a frame and corresponding and aligned handle and leg portions, and a stabilizer subassembly with lateral support portions. Each of the subassemblies is attached or mounted in combination with a conventional ladder for cooperating to raise an object from the ground or a base surface to the roof of a building or elevated surface. The winch mounting subassembly is mounted on a consecutive pair of rungs of a ladder and supports a conventional winch with a hoist line in a secure position for lifting an object. The reversible mount bracket subassembly is slid and guided into position over the upper portion of a ladder's siderails, and supports a conventional pulley unit to receive and transmit the hoist line from the winch supported on the winch mounting subassembly to the ground surface for use in lifting and lowering an object. The tiltable prop subassembly engages a rung of a ladder and extends the ladder away from a flat or slanted roof to permit an object being lifted from the ground to pass between the ladder and the building, and through and within the frame portion of the subassembly itself. The safety rung support extension portion has a backup safety channel for engaging a ladder rung if it slips from a primary support channel. The stabilizer subassembly has corresponding tracked portions to guide the support feet of a ladder into secure position and prevent movement of the ladder along any axis from its installed position.

U.S. Pat. No. 5,427,356 to Krotov, et al. discloses a ladder which attaches to a wheel-base type stabilizer which aids in rolling the object onto and off a roof or other elevated area. The ladder attaches to the wheel base stabilizer with two "U" shaped channels which receive two of the ladder rungs and the rungs are locked in place with two slip pins on the underside. At the top of the ladder is a leg which also has two "U" shaped channels which slip over the rungs of the ladder and are locked in place with two slip pins. A boom, with a mating square tube welded to it, receives the leg which is attached to the top of the ladder. A leg and wheel assembly are assembled into a second mating square tube welded to the other end of the boom and held in place with a slip pin.

U.S. Pat. No. 6,454,049 to Dorsett discloses a portable lifting apparatus, removably attached to a ladder, comprising an electrically powered inch mounted on a rigid frame having a pivotally attached brace.

U.S. Pat. No. 6,830,130 to Webb, et al. discloses a vertically placed ladder positioned approximately 3 to 5 feet from a building and having attached thereto a horizontal beam which is also attached to a vertical stand placed on the roof of the one-story building. The horizontal beam has a U-shaped interior channel within which there is located a roller assembly designed to roll along tracks within the interior of the U-shaped channel, either flat or semi-circular, along the length of the horizontal beam and has attached thereto a winch line which is connectable to a load to be lifted from the earth's surface in a vertical line. The roller assembly also allows the load to be moved along a straight horizontal line until the load is above the surface upon which the load is to be deposited, and then the winch line allows the load to be lowered to the surface upon which the load is to be deposited.

Although the aforementioned prior art have contributed to the development of the art of raising heavy cargo none of these prior art patents have solved the needs of this art.

Therefore, it is an object of the present invention to provide an improved load raising device to fill the needs of this art.

Another object of this invention is to provide an improved load raising device that is simple and safe for an operator to use.

Another object of this invention is to provide an improved load raising device that utilizes components used for other tasks.

Another object of this invention is to provide an improved load raising device that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a lift for engaging a ladder. The lifting device comprises a base frame extending between a proximal end and a distal end. A load bearing frame is coupled to the base frame and defines a generally perpendicular orientation relative to the base frame. An elevation reducing frame is coupled to the load bearing frame and defines a descending frame portion and a generally perpendicular orientation relative to the load bearing frame. An extension frame is coupled to the elevation reducing frame and defines a generally perpendicular orientation relative to the elevation reducing frame. A mounting bracket is coupled to the base frame and defines a generally perpendicular orientation relative to the base frame. The mounting bracket engages a rung of a ladder. A load winch is coupled to the load bearing frame. A lifting cord extends between a proximal end and a distal end. The proximal end is coupled to the load winch and the distal end is coupled to the object. The load winch produces a tensile stress in the lifting cord upon lifting the object and transferring the weight of the object to the ladder during positioning the object between the first elevation and the second elevation. The base frame, the load bearing frame and the elevation reducing frame define an object chamber for receiving the object in the object chamber and increasing the elevation of the object relative to the extension frame.

In one embodiment of the invention, a handle frame is coupled to the primary extension frame and the second extension frame. The handle frame assists in grasping and altering the angle of the primary load bearing frame and the secondary load bearing frame relative to the first elevation and/or the second elevation.

In another embodiment of the invention, the load winch includes a winch drum for spooling the lifting cord. A worm gear engages the winch drum. A worm shaft engages the worm gear. A rotation force mechanism engages the worm shaft and rotates the winch drum. The rotation force mechanism includes an electric drill.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
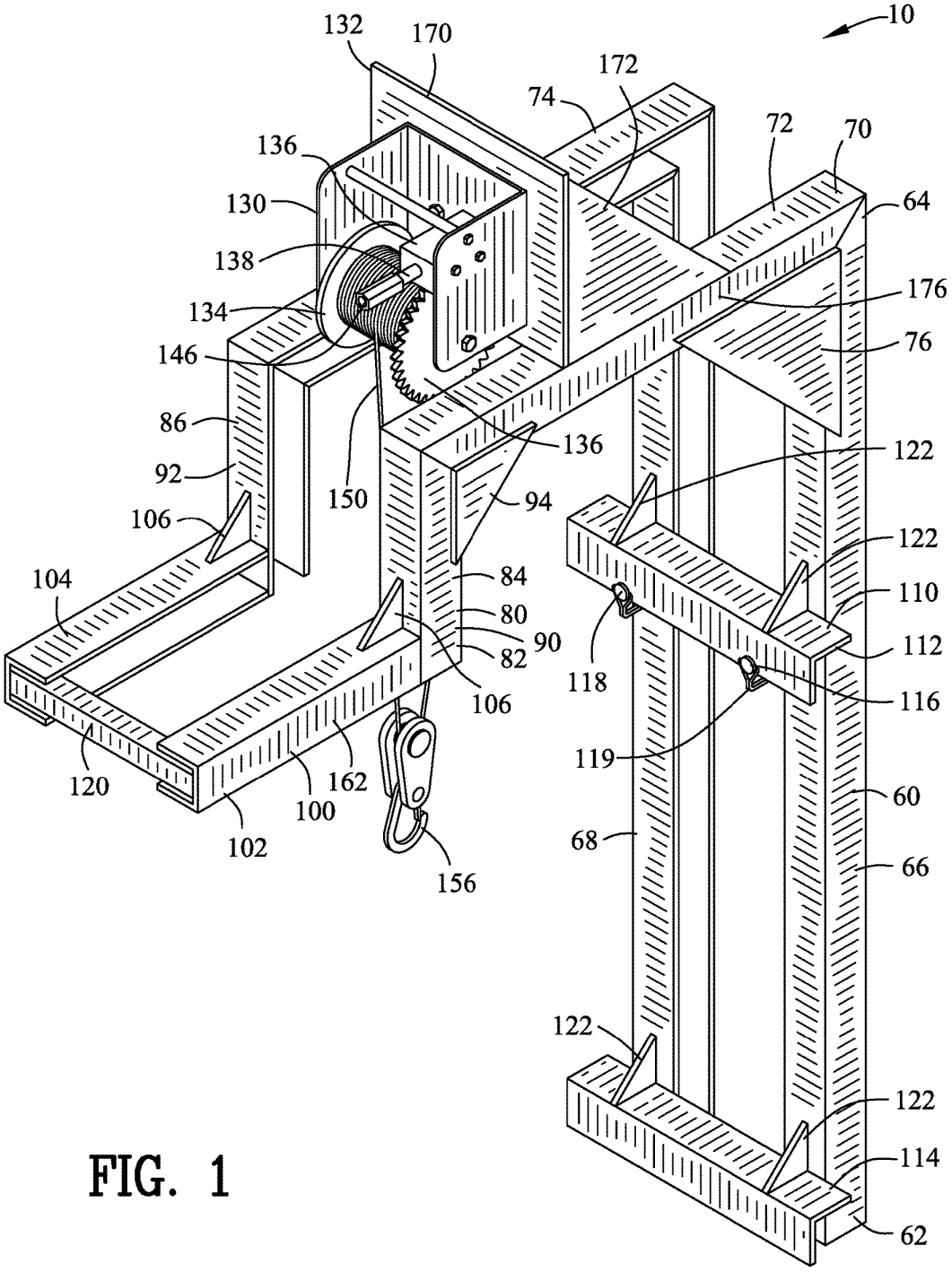
FIG. 1 is a front upper isometric view of a lifting device incorporating the present invention.
Figure 3:
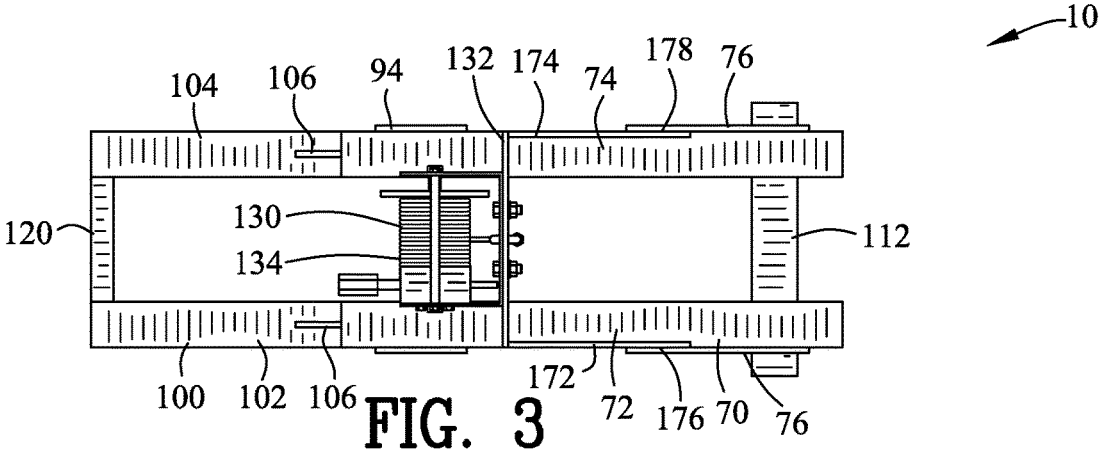
FIG. 3 is a top view of FIG. 2.
Figure 2:
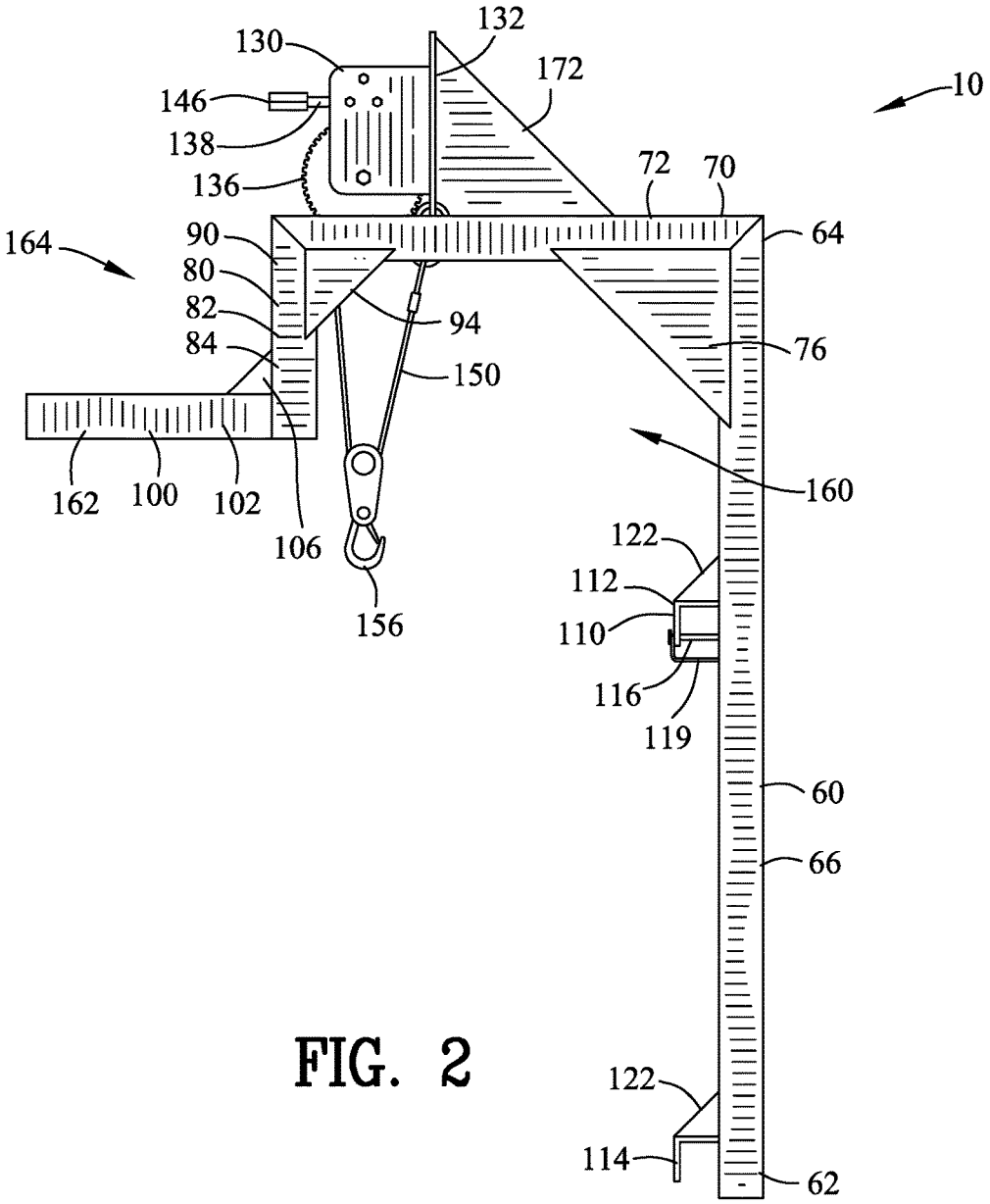
FIG. 2 is a left side view of FIG. 1.
Figure 4:
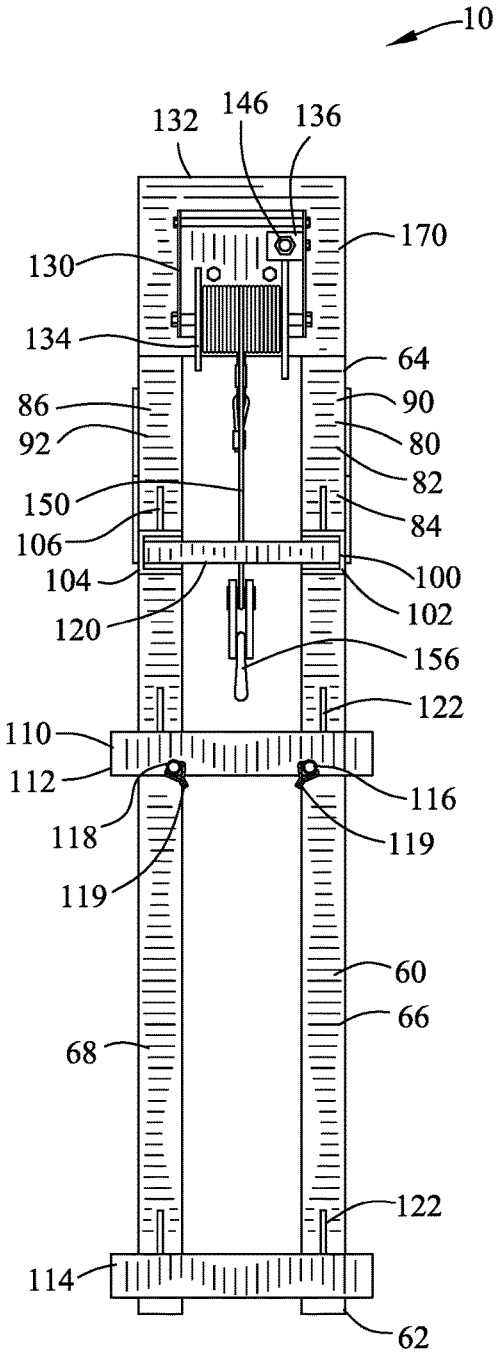
FIG. 4 is front view of FIG. 1.
Figure 5:
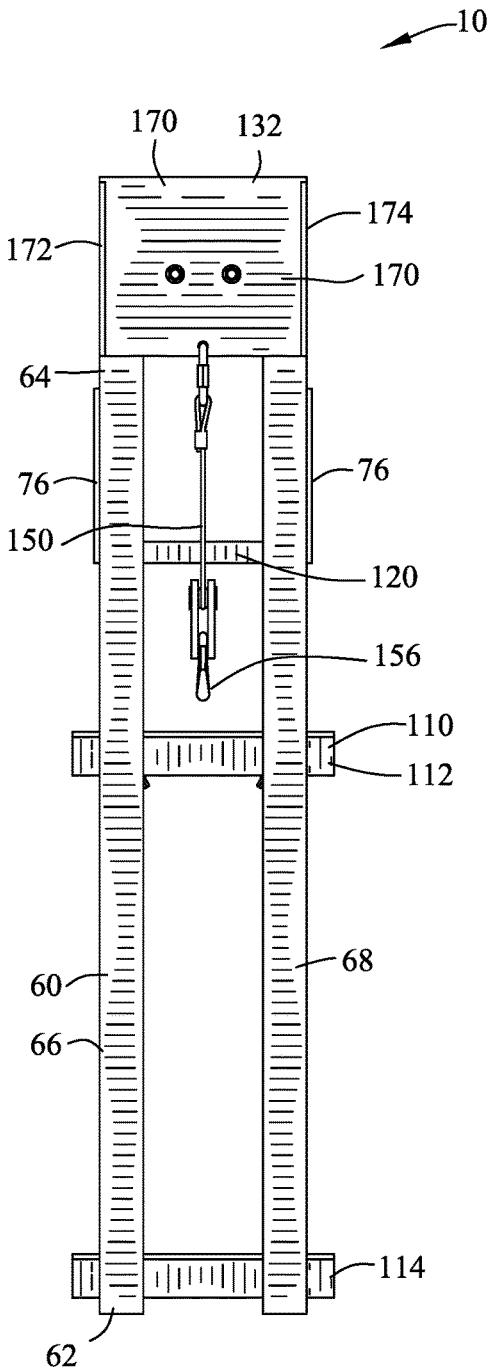
FIG. 5 is a rear view of FIG. 1.
Figure 6:
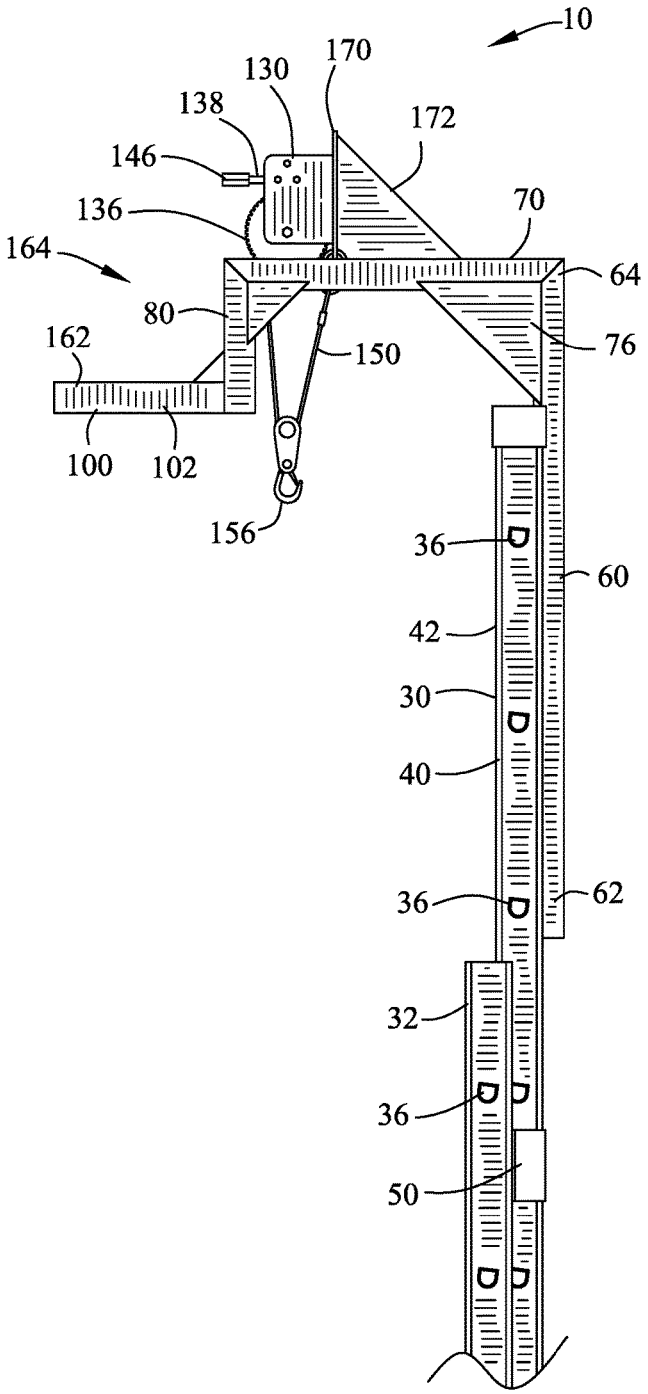
FIG. 6 is a view similar to FIG. 2 illustrating the lifting device coupled to a ladder.
Figure 7:
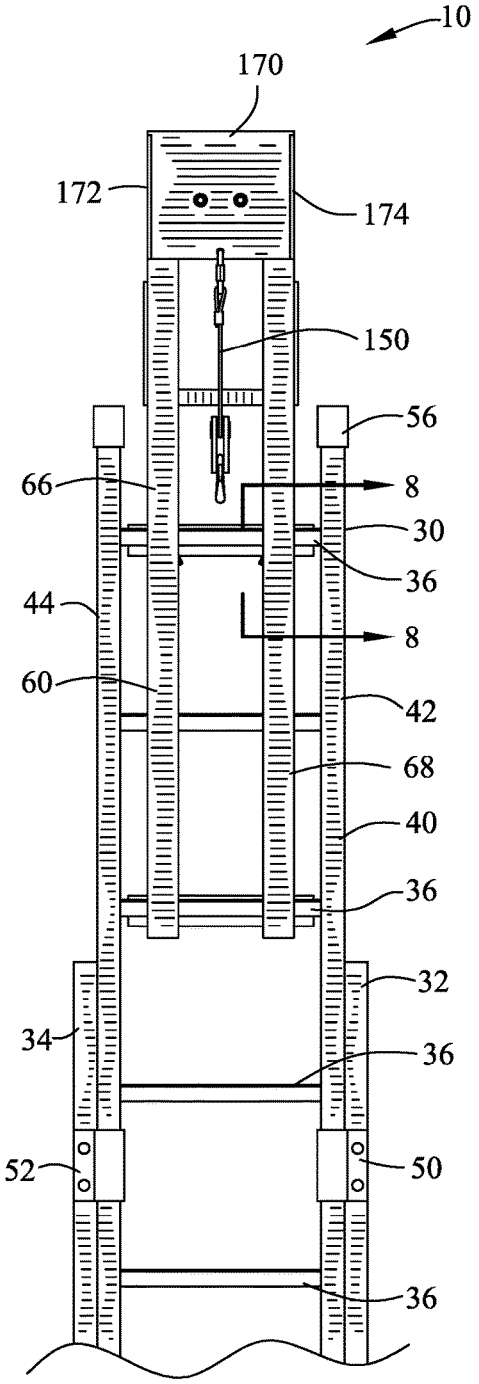
FIG. 7 is a right side view of FIG. 6.
Figure 8:
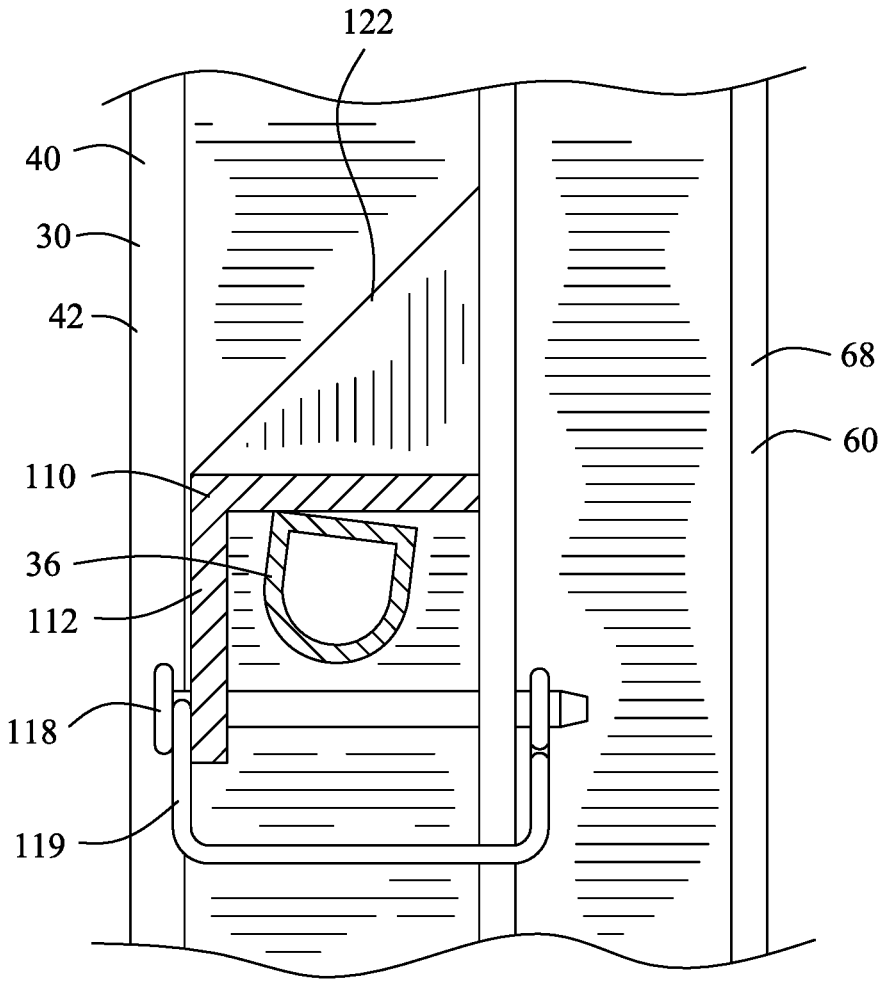
FIG. 8 is a sectional view along line 8-8 in FIG. 7.
Figure 9:
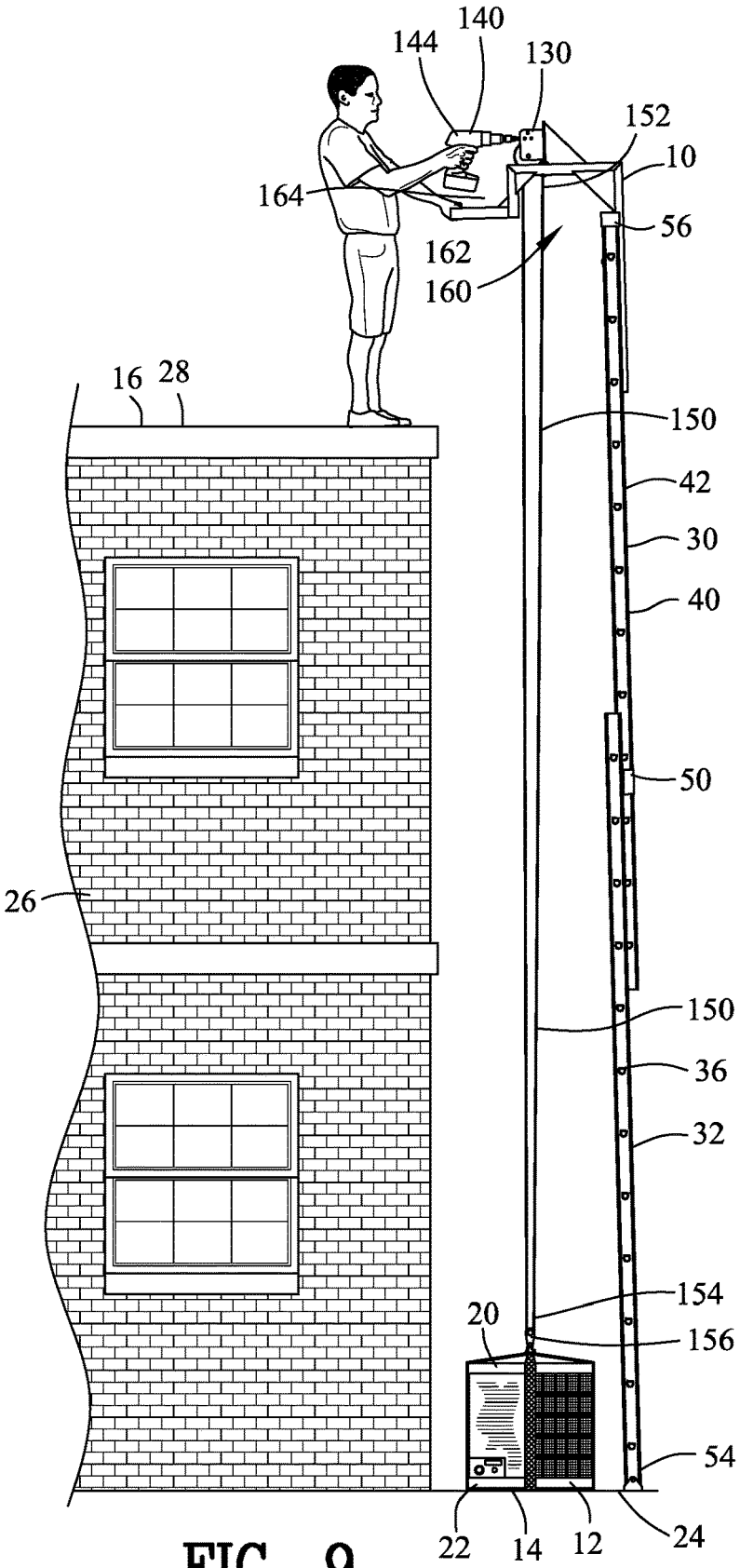
FIG. 9 is a view similar to FIG. 6 illustrating the lifting device linked to the object on a ground surface wherein the ladder has a general vertical orientation.
Figure 10:
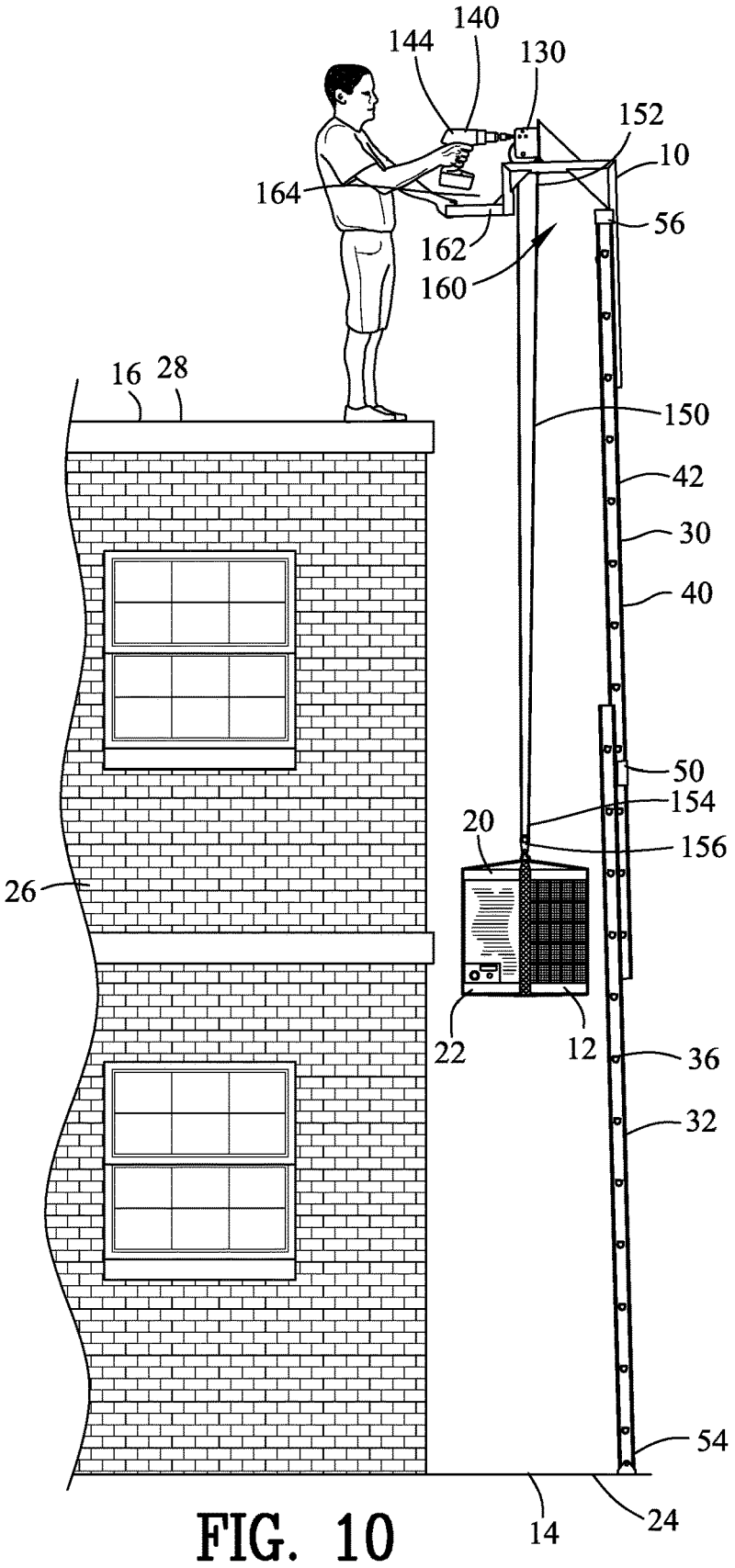
FIG. 10 is a view similar to FIG. 9 illustrating an electric drill operating a load winch for raising the object.
Figure 11:
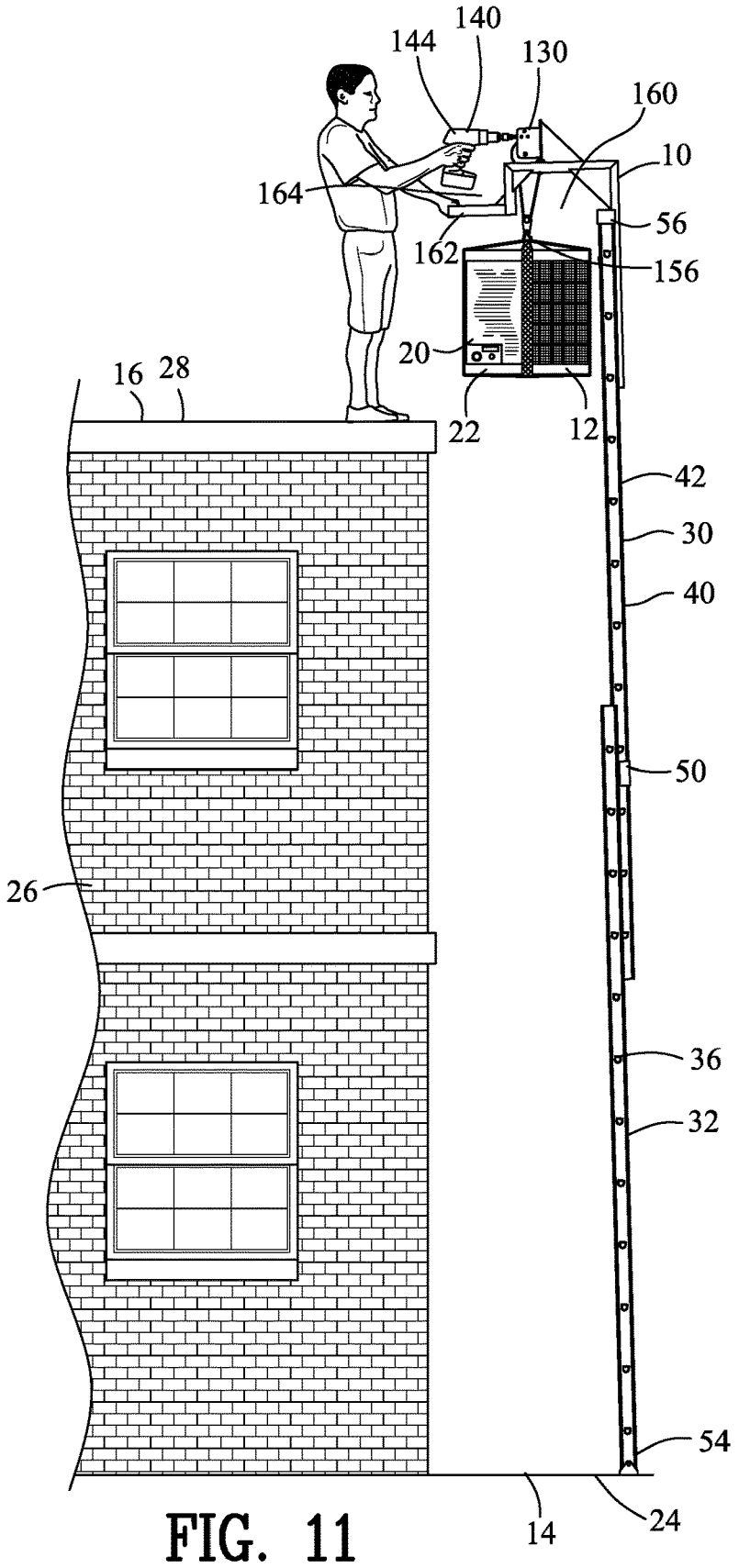
FIG. 11 is a view similar to FIG. 10 illustrating an electric drill further operating the load winch for further raising the object.

FIGS. 1-16 illustrate a lifting device 10 for elevating an object 12 between a first elevation 14 and a second elevation 16. The object 12 is shown as an air conditioner condenser 20, however the object 12 may include building materials, electrical equipment, containers, or other items. The object has a weight 22. The first elevation 14 is shown as a ground surface 24. A building 26 includes a rooftop 28 or second elevation 16.

The lifting device 10 engages to a ladder 30. The ladder 30 includes a primary side rail 32, a secondary side rail 34 and a plurality of rungs 36 extending between the primary side rail 32 and the secondary side rail 34. The ladder 30 may further include an extension ladder 40 including an extension primary side rail 42, an extension secondary side rail 44 and a plurality of rungs 36 extending between the extension primary side rail 42 and the extension secondary side rail 44. A primary side rail guide 50 and a secondary side rail guide 52 permit the extension primary side rail 42 and the extension secondary side rail 44 to slide relative to the primary side rail 32 and the secondary side rail 34. The ladder 30 extends from a lower end 54 and an upper end 56.

The lifting device 10 comprises a base frame 60 extending between a proximal end 62 and a distal end 64. The base frame 60 may include a primary base frame 66 and a secondary base frame 68 extending between a proximal end 62 and a distal end 64.

A load bearing frame 70 is coupled to the base frame 60 and defines a generally perpendicular orientation relative to the base frame 60. The load bearing frame 70 may include a primary load bearing frame 72 and a secondary load bearing frame 74 coupled to the primary base frame 66 and the second base frame 68 respectively, and defining a generally perpendicular orientation relative to the primary base frame 66 and the second base frame 68 respectively. Base frame gusset plates 76 may further couple the primary load bearing frame 72 and a secondary load bearing frame 74 to the primary base frame 66 and the second base frame 68 respectively.

An elevation reducing frame 80 is coupled to the load bearing frame 70 and defines a descending frame portion 82 and a generally perpendicular orientation relative to the load bearing frame 70. The elevation reducing frame 80 may include a primary elevation reducing frame 84 and a secondary elevation reducing frame 86 coupled to the primary load bearing frame 72 and the secondary load bearing frame 74 respectively, and defining a primary descending frame portion 90 and a secondary descending frame portion 92 respectively and a generally perpendicular orientation relative to the primary load bearing frame 72 and the secondary load bearing frame 74 respectively. Elevation frame gusset plates 94 may further couple the primary elevation reducing frame 84 and a secondary elevation reducing frame 86 to the primary load bearing frame 72 and the secondary load bearing frame 74 respectively.

An extension frame 100 is coupled to the elevation reducing frame 80 and defines a generally perpendicular orientation relative to the elevation reducing frame 80. The extension frame 100 may include a primary extension frame 102 and a second extension frame 104 coupled to the primary elevation reducing frame 84 and the secondary elevation reducing frame 86 respectively, and defining a generally perpendicular orientation relative to the primary elevation reducing frame 84 and the secondary elevation reducing frame 86 respectively. Extension frame gusset plates 106 may further coupled the primary extension frame 102 and a second extension frame 104 to the primary elevation reducing frame 84 and the secondary elevation reducing frame 86 respectively.

Preferably, the base frame 60, load bearing frame 70, elevation reducing frame 80, extension frame 100 include a U shape channel constructed from aluminum, steel or other rigid materials.

A mounting bracket 110 is coupled to the base fame 60 and defines a generally perpendicular orientation relative to the base frame 60. The mounting bracket 110 engages one of the plurality of rungs 36. The mounting bracket 110 may includes a primary mounting bracket 112 and a secondary mounting bracket 114 coupled to the primary base frame 66 and the secondary base frame 68 and defining a generally perpendicular orientation relative to the primary base frame 66 and second secondary base frame 68 respectively. The primary mounting bracket 112 engages one of the plurality of rungs 36 and the secondary mounting bracket 114 engages one of the plurality of rungs 36. Preferably, the mounting bracket 110 includes a L shape channel constructed from aluminum, steel or other rigid materials. Mounting bracket gusset plates 122 may further couple the primary mounting bracket 112 and a secondary mounting bracket 114 to the primary base frame 66 and the secondary base frame 68 respectively.

A primary safety pin 116 engages the primary mounting bracket 112 and the primary base frame 66. A secondary safety pin 118 engages the primary mounting bracket 112 and the secondary base frame 68. The primary safety pin 116 and the secondary safety pin 118 encircle the rung 36 and prevent the disengagement of the primary mounting bracket 112 with the rung 36. A pin retainer 119 may engage the primary safety pin 116 and the secondary safety pin 118 for preventing disengagement of the primary mounting bracket 112 and the primary base frame 66 and the primary mounting bracket 112 and the secondary base frame 68.

A handle frame 120 is coupled to the primary extension frame 102 and the second extension frame 104. The handle frame 120 assists in grasping and altering the angle of the primary load bearing frame 72 and the secondary load bearing frame 74 relative to the first elevation 14 and/or the second elevation 16.

A load winch 130 is coupled to the load bearing frame 70. A load bearing plate 132 may couple the primary load bearing frame 72 and the secondary load bearing frame 74. The load winch 130 is secured to the load bearing plate 132. The load bearing plate 132 may include a vertical load bearing frame 170. In addition a horizontal load bearing frame may be coupled to the vertical load bearing frame 170 and extend between the primary load bearing frame 72 and the secondary load bearing frame 74. A primary vertical gusset plate 172 may be coupled between the vertical load bearing frame 170 and the primary load bearing frame 72. Similarly, a secondary vertical gusset plate 174 may be coupled between the vertical load bearing frame 170 and the secondary load bearing frame 74. As best shown in FIGS. 1-3 and 6, the base frame gusset plate 76 of the primary load bearing frame 72 and the primary vertical gusset plate 172 define a primary gusset vertical overlap 176 for strengthening the load winch 130 with the primary load bearing frame 72. Similarly, the base frame gusset plate 76 of the secondary load bearing frame 74 and the secondary vertical gusset plate 174 define a secondary gusset vertical overlap 178 for strengthening the load winch 130 with the secondary load bearing frame 74.

The load winch 130 may include a winch drum 134 for spooling a lifting cord 150. The lifting cord 150 extends between a proximal end 152 and a distal end 154. The proximal end 152 is coupled to the load winch 130 and the distal end 154 is coupled to the object 12. The distal end 154 may include a safety clip 156 for quickly engaging and disengaging the distal end 154 with the object 12.

A worm gear 136 engages the winch drum 134. A worm shaft 138 engages the worm gear 136. A rotation force mechanism 140 engages the worm shaft 138 and rotates the winch drum 134 for increasing or decreasing the length of the lifting cord 150. The rotation force mechanism 140 may includes a hand crank 142. Alternatively, the rotation force mechanism 140 may include a battery powered electric drill 144. Preferably, the worm shaft 138 includes a hex head 146 for keying engaging with the rotation force mechanism 140, hand crank 142 or battery powered electric drill 144.

The load winch 130 produces a tensile stress in the lifting cord 150 upon lifting the object 12 and transferring the weight 22 of the object 12 to the ladder 30 during positioning the object 12 between the first elevation 14 and the second elevation 16. The combination of the worm gear 136 and worm shaft 138 will prevent displacement of the load winch 130 and the lowering of the object 12 when the object 12 is lifted from the first elevation 14 and the rotation force mechanism 140 is disengaged from the load winch 130. As such, if during lift of the object 12 from the first elevation 14 to the second elevation 16 or from the second elevation 16 to the first elevation 14, the battery powered electric drill 144 dies, the drill 144 may be removed and replaced with the hand crank 142 without the object 12 being displaced relative to the ladder 30.

Figure 14:
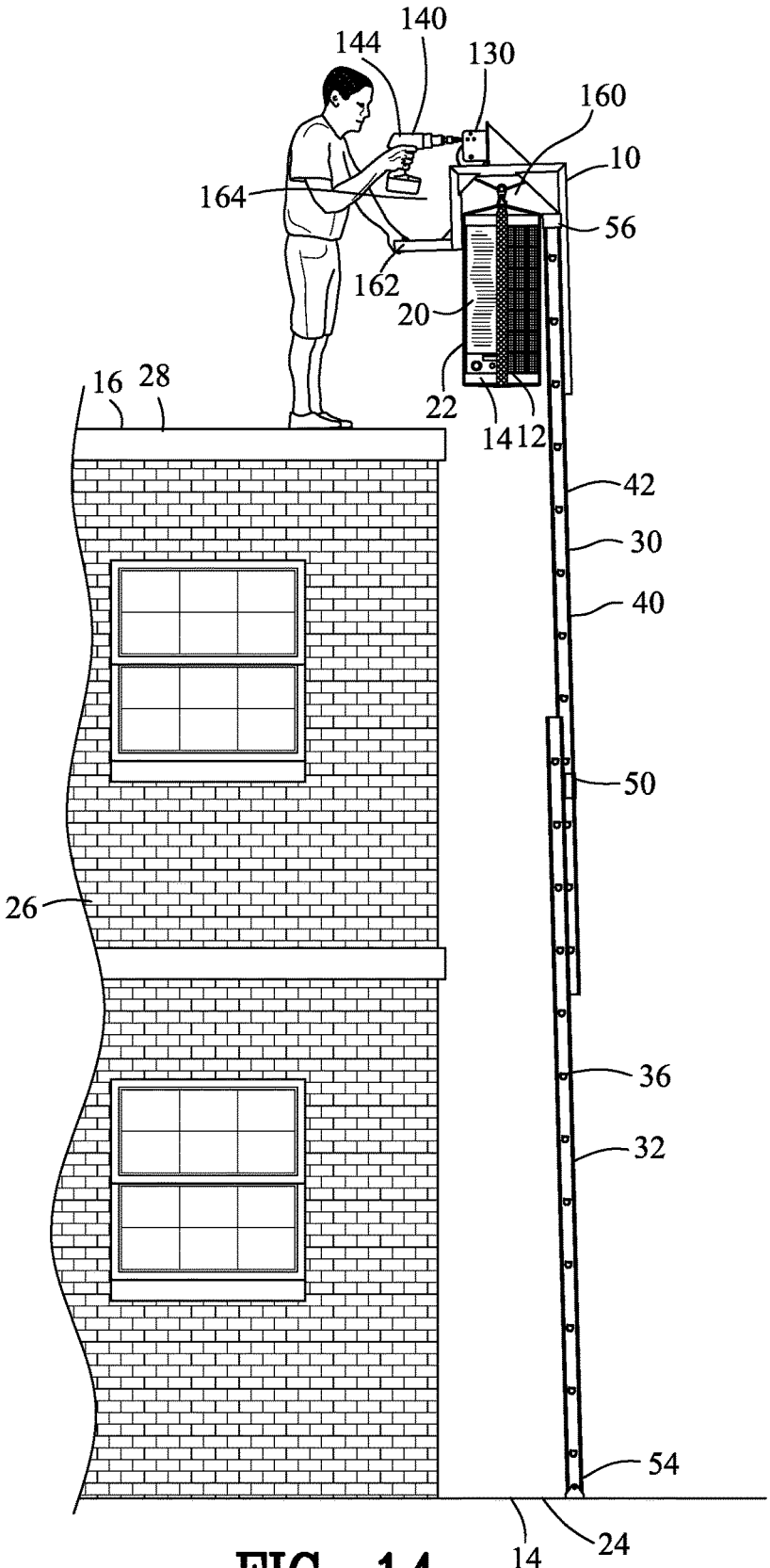
FIG. 14 is a view similar to FIG. 11 illustrating the object partially positioned within an object chamber of the lifting device for increasing the elevation of the object relative to the ladder.
Figure 15:
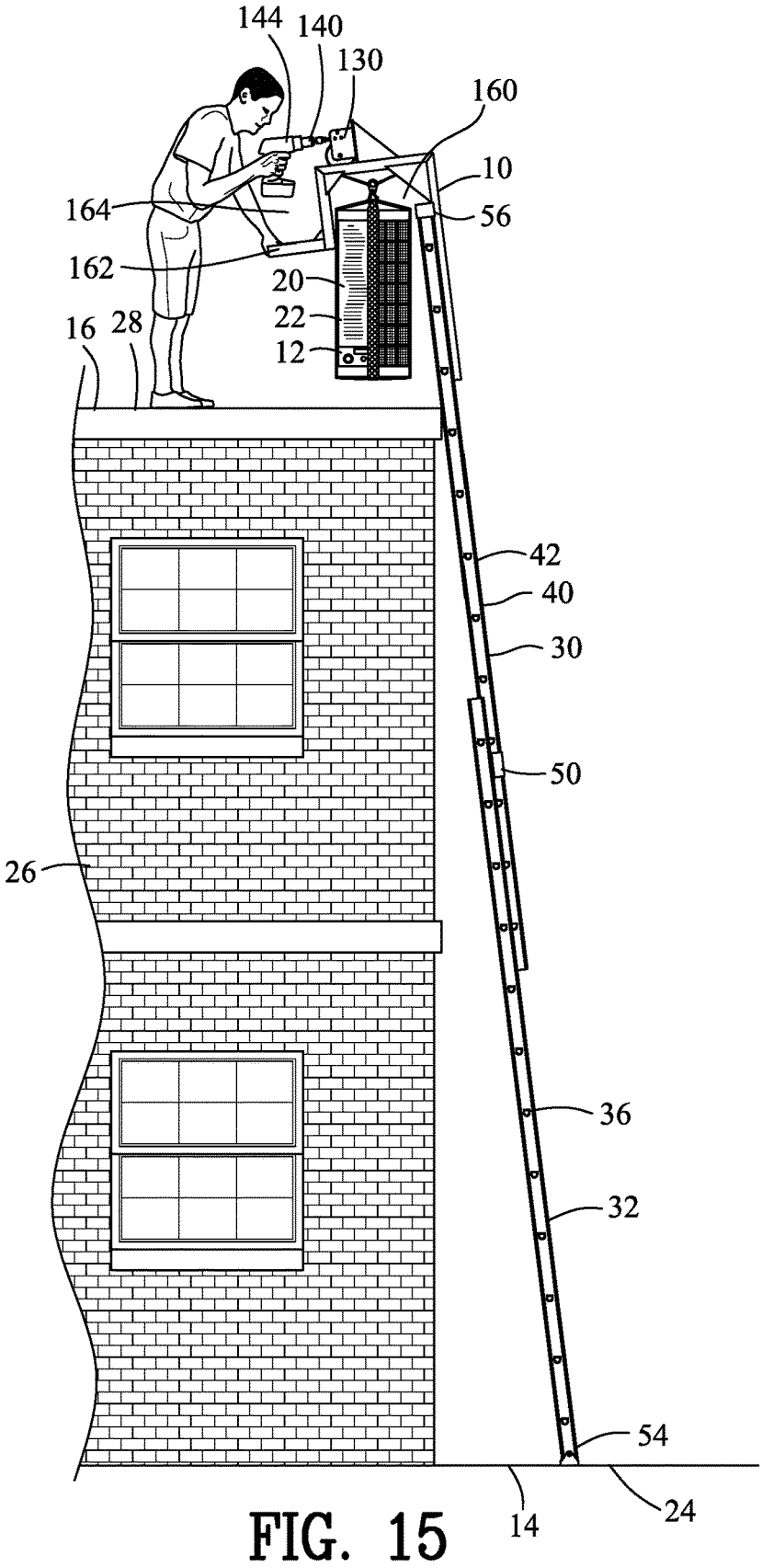
FIG. 15 is view similar to FIG. 14 illustrating the lifting device and ladder displaced towards the individual for positioning the object over the building.
Figure 16:
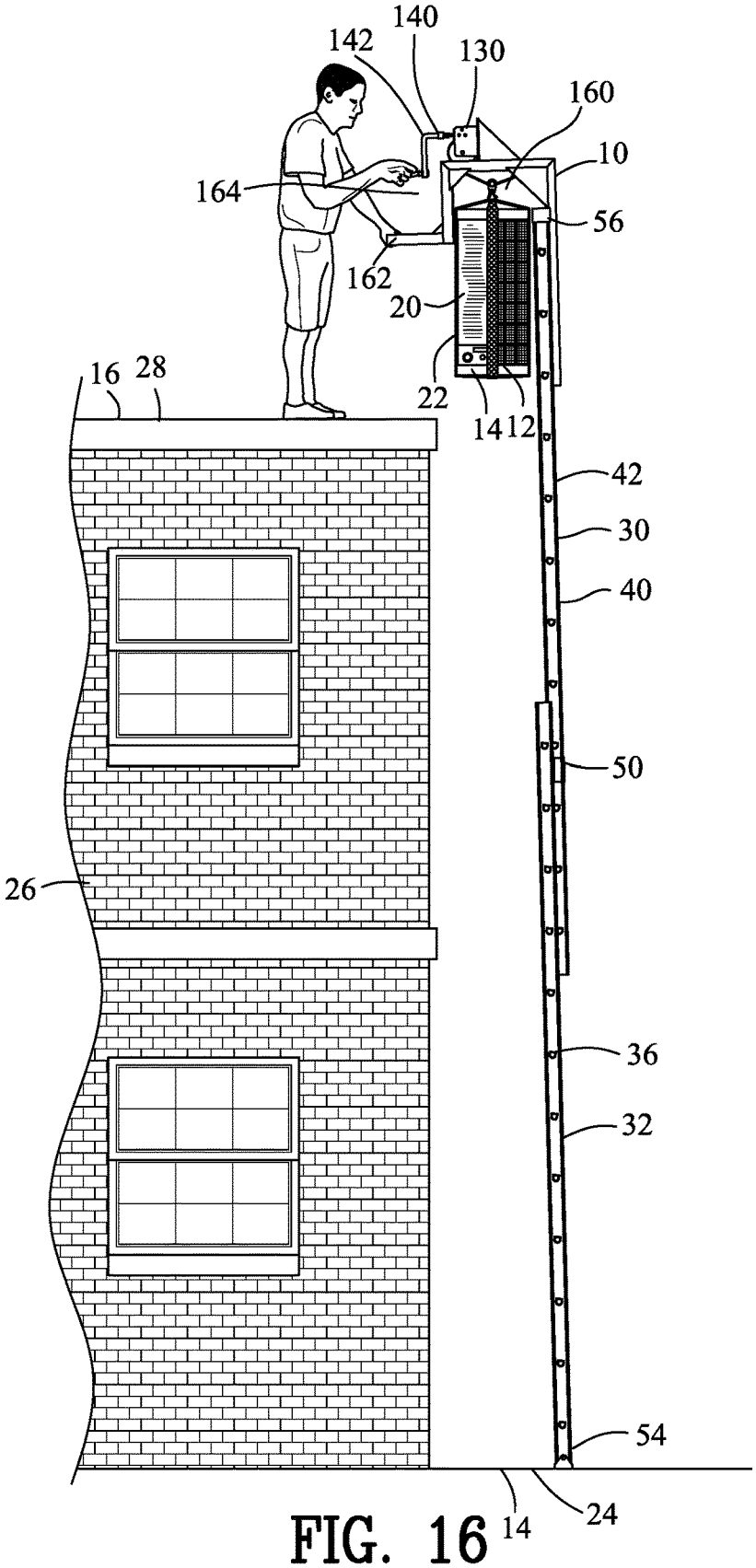
FIG. 16 is a view similar to FIG. 14 illustrating a hand crank operating the load winch.

As best shown in FIGS. 14-16, the base frame 60, the load bearing frame 70 and the elevation reducing frame 80 may define an object chamber 160 for receiving the object 12 in the object chamber 160 and increasing the elevation of the object 12 relative to the extension frame 100 and the ladder 30. Similarly, the primary base frame 66, the secondary base frame 68, the primary load bearing frame 72, the secondary load bearing frame 74, the primary elevation reducing frame 84 and the secondary elevation reducing frame 86 define an object chamber 160 for receiving the object 12 in the object chamber 160 and increasing the elevation of the object 12 relative to the extension frame 100 and the ladder 30.

As best shown in FIGS. 9-16, the primary load bearing frame 72, the secondary load bearing frame 74, the primary elevation reducing frame 84, the secondary elevation reducing frame 86, the primary extension frame 102 and the second extension frame 104 may define an exterior descending step 162. The exterior descending step 162 defines an exterior step area 164. The exterior descending step 162 decreases the elevation of the extension frame 100. The rotation force mechanism 140 is positioned within the exterior step area 164 for decreasing the elevation of the rotation force mechanism 140 relative to the extension frame 100 and the ladder 30.

Figure 12:
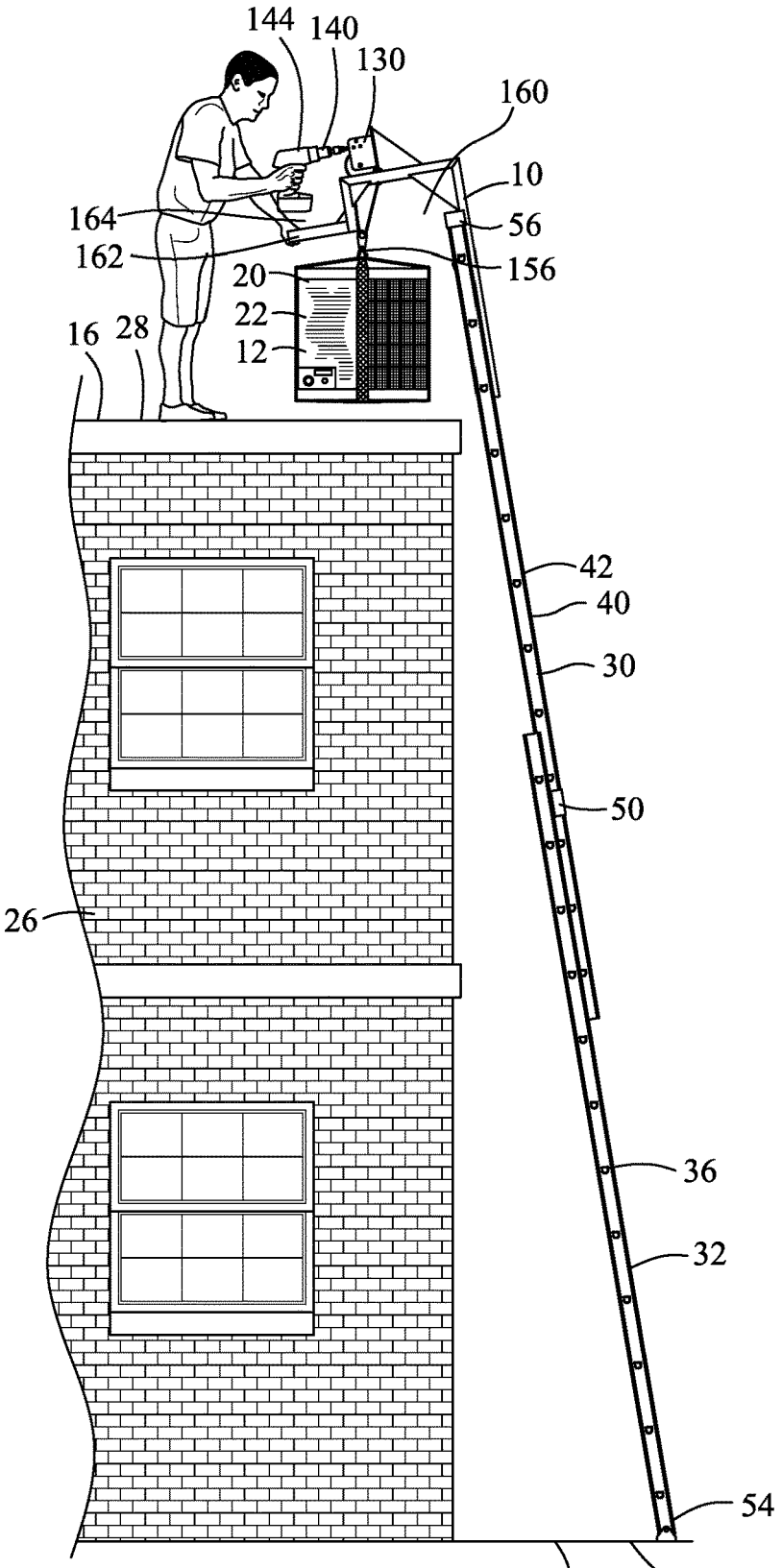
FIG. 12 is view similar to FIG. 11 illustrating the lifting device and ladder displaced towards an individual for positioning the object over a building.
Figure 13:
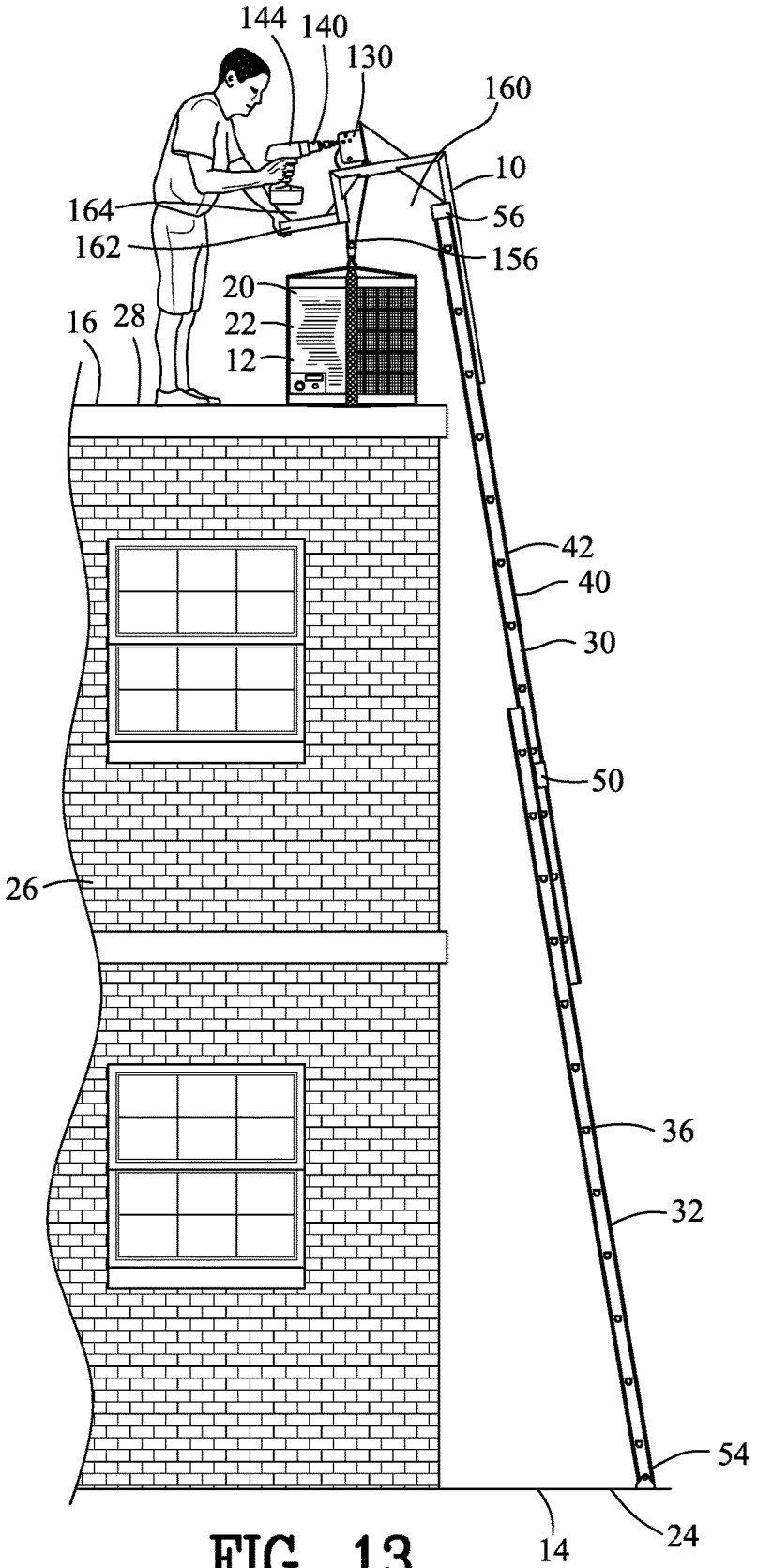
FIG. 13 is a view similar to FIG. 12 illustrating an electric drill operating the load winch for lowering the object on the building.

FIGS. 9-16 illustrate the method of elevating the object 12 between the first elevation 14 and the second elevation 16. As shown in FIGS. 9-11, 14 and 16, during transitioning the object 12 between the first elevation 14 and the second elevation 16, the operator gasps both the handle frame 120 and the rotation force mechanism 140 while maintaining the ladder 30 in a vertical orientation. After the object 12 has cleared the roof top 28 the rotation force mechanism 140 is terminated. As shown in FIGS. 12 and 15, the operator then displaces lifting device 10 towards the building for positioning the object 12 above the rooftop 28. As shown in FIG. 13, the operator then activates the rotation force mechanism 140 for lowering the object 12 on to the roof top 28. The process is reversed to positioning the object 12 from the roof top 28 to the ground surface 24.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A lifting device for elevating an object between a first elevation and a second elevation, the object have a weight, the lifting device engaging to a ladder, the ladder including a primary side rail, a secondary side rail and a plurality of rungs extending between the primary side rail and the secondary side rail, the lifting device comprising:

a base frame extending between a proximal end and a distal end;

a load bearing frame coupled to said base frame and defining a generally perpendicular orientation relative to said base frame;

an elevation reducing frame coupled to said load bearing frame and defining a descending frame portion and a generally perpendicular orientation relative to said load bearing frame;

an extension frame coupled to said elevation reducing frame and defining a generally perpendicular orientation relative to said elevation reducing frame;

a mounting bracket coupled to said base frame and defining a generally perpendicular orientation relative to said base frame;

said mounting bracket engaging one of the plurality of rungs;

a load winch coupled to said load bearing frame;

a lifting cord extending between a proximal end and a distal end;

said proximal end of said lifting cord coupled to said load winch and said distal end of said lifting cord coupled to the object;

said load winch producing a tensile stress in said lifting cord upon lifting the object and transferring the weight of the object to the ladder during positioning the object between the first elevation and the second elevation;

said base frame, said load bearing frame and said elevation reducing frame defining an object chamber for receiving the object in said object chamber and increasing the elevation of the object relative to said extension frame;

said load bearing frame, said elevation reducing frame and said extension frame defining an exterior descending step;

said exterior descending step defining an exterior step area;

a handle coupled to said extension frame;

said elevation reducing frame decreasing the elevation of said handle relative to said load bearing frame;

a rotation force mechanism engaging said load winch;

said rotation force mechanism positioned with said exterior step area for decreasing the elevation of said rotation force mechanism relative to said load bearing frame; and said exterior descending step permitting simultaneous grasping said handle and grasping said rotation force mechanism during elevating the object between the first elevation and the second elevation.

2. A lifting device for elevating an object between a first elevation and a second elevation as set forth in claim 1, wherein said base frame includes a primary base frame and a secondary base frame extending between a proximal end and a distal end;

said load bearing frame includes a primary load bearing frame and a secondary load bearing frame coupled to said primary base frame and said second base frame respectively, and defining a generally perpendicular orientation relative to said primary base frame and said second base frame respectively;

said elevation reducing frame includes a primary elevation reducing frame and a secondary elevation reducing frame coupled to said primary load bearing frame and said secondary load bearing frame respectively, and defining a primary descending frame portion and a secondary descending frame portion respectively and a generally perpendicular orientation relative to said primary load bearing frame and said secondary load bearing frame respectively;

said extension frame includes a primary extension frame and a second extension frame coupled to said primary elevation reducing frame and said secondary elevation reducing frame respectively, and defining a generally perpendicular orientation relative to said primary elevation reducing frame and said secondary elevation reducing frame respectively;

said mounting bracket includes a primary mounting bracket and a secondary mounting bracket coupled to said primary base frame and said secondary base frame and defining a generally perpendicular orientation relative to said primary base frame and second secondary base frame respectively;

said primary mounting bracket engaging one of the plurality of rungs and said secondary mounting bracket engaging one of the plurality of rungs;

said load winch coupled to said primary load bearing frame and said secondary load bearing frame; and said primary base frame, said secondary base frame, said primary load bearing frame, said secondary load bearing frame, said primary elevation reducing frame and said secondary elevation reducing frame defining said object chamber for receiving the object in said object chamber and increasing the elevation of the object relative to said extension frame.

3. A lifting device for elevating an object between a first elevation and a second elevation as set forth in claim 2, further including a load bearing plate coupling said primary load bearing frame and said secondary load bearing frame; and said load winch secured to said load bearing plate.

4. A lifting device for elevating an object between a first elevation and a second elevation as set forth in claim 2, further including a handle frame coupled to said primary extension frame and said second extension frame; and said handle frame assisting in grasping and altering the angle of said primary load bearing frame and said secondary load bearing frame relative to the first elevation and/or the second elevation.

5. A lifting device for elevating an object between a first elevation and a second elevation as set forth in claim 2, further including a primary safety pin engaging said primary mounting bracket and said primary base frame;

a secondary safety pin engaging said primary mounting bracket and said secondary base frame; and said primary safety pin and said secondary safety pin encircling the rung and preventing the disengagement of said primary mounting bracket with the rung.

6. A lifting device for elevating an object between a first elevation and a second elevation as set forth in claim 1, wherein said load winch includes a winch drum for spooling said lifting cord;

a worm gear engaging said winch drum;

a worm shaft engaging said worm gear; and a rotation force mechanism engaging said worm shaft and rotating said winch drum.

7. A lifting device for elevating an object between a first elevation and a second elevation as set forth in claim 1, wherein said rotation force mechanism includes a hand crank.

8. A lifting device for elevating an object between a first elevation and a second elevation as set forth in claim 1, wherein said rotation force mechanism includes an electric drill.

9. A lifting device for elevating an object between a first elevation and a second elevation, the object have a weight, the lifting device engaging to a ladder, the ladder including a primary side rail, a secondary side rail and a plurality of rungs extending between the primary side rail and the secondary side rail, the lifting device comprising:

a base frame extending between a proximal end and a distal end;

a load bearing frame coupled to said base frame and defining a generally perpendicular orientation relative to said base frame;

an elevation reducing frame coupled to said load bearing frame and defining a descending frame portion and a generally perpendicular orientation relative to said load bearing frame;

an extension frame coupled to said elevation reducing frame and defining a generally perpendicular orientation relative to said elevation reducing frame;

a mounting bracket coupled to said base frame and defining a generally perpendicular orientation relative to said base frame;

said mounting bracket engaging one of the plurality of rungs;

a load winch coupled to said load bearing frame;

a lifting cord extending between a proximal end and a distal end;

said proximal end of said lifting cord coupled to said load winch and said distal end of said lifting cord coupled to the object;

said load winch producing a tensile stress in said lifting cord upon lifting the object and transferring the weight of the object to the ladder during positioning the object between the first elevation and the second elevation;

said load bearing frame, said elevation reducing frame and said extension frame defining an exterior descending step;

said exterior descending step defining an exterior step area;

a handle coupled to said extension frame;

said elevation reducing frame decreasing the elevation of said handle relative to said load bearing frame;

a rotation force mechanism engaging said load winch;

said rotation force mechanism positioned with said exterior step area for decreasing the elevation of said rotation force mechanism relative to said load bearing frame; and said exterior descending step permitting simultaneous grasping said handle and grasping said rotation force mechanism during elevating the object between the first elevation and the second elevation.

* * * * *